US010261433B2

(12) United States Patent
Yamada et al.

(10) Patent No.: US 10,261,433 B2
(45) Date of Patent: Apr. 16, 2019

(54) LIQUID DEVELOPER

(71) Applicant: Kao Corporation, Tokyo (JP)

(72) Inventors: Tatsuya Yamada, Wakayama (JP); Nobumichi Kamiyoshi, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 15/752,642

(22) PCT Filed: Aug. 12, 2016

(86) PCT No.: PCT/JP2016/073753
§ 371 (c)(1),
(2) Date: Feb. 14, 2018

(87) PCT Pub. No.: WO2017/033772
PCT Pub. Date: Mar. 2, 2017

(65) Prior Publication Data

US 2018/0239269 A1 Aug. 23, 2018

(30) Foreign Application Priority Data

Aug. 27, 2015 (JP) ..... 2015-167829
May 2, 2016 (WO) ..... PCT/JP2016/063568

(51) Int. Cl.

| | |
|---|---|
| ***G03G 9/00*** | (2006.01) |
| ***G03G 9/13*** | (2006.01) |
| ***G03G 9/12*** | (2006.01) |
| ***G03G 9/08*** | (2006.01) |
| ***G03G 9/09*** | (2006.01) |
| ***G03G 9/125*** | (2006.01) |

(52) U.S. Cl.
CPC ..... *G03G 9/132* (2013.01); *G03G 9/081* (2013.01); *G03G 9/0804* (2013.01); *G03G 9/0819* (2013.01); *G03G 9/0827* (2013.01); *G03G 9/09* (2013.01); *G03G 9/12* (2013.01); *G03G 9/125* (2013.01); *G03G 9/13* (2013.01)

(58) Field of Classification Search
CPC ..... G03G 9/125; G03G 9/132
USPC ..... 430/116
See application file for complete search history.

(56) References Cited

U.S. PATENT DOCUMENTS

| | | | |
|---|---|---|---|
| 5,998,075 | A | 12/1999 | Fujiwara et al. |
| 6,029,036 | A | 2/2000 | Itaya et al. |
| 6,207,336 | B1 | 3/2001 | Itaya et al. |
| 2003/0104304 | A1 | 6/2003 | Nicholls |
| 2004/0259015 | A1 | 12/2004 | Tsubuko et al. |
| 2009/0238606 | A1 | 9/2009 | Ueno et al. |
| 2009/0253067 | A1 | 10/2009 | Yoshie et al. |
| 2013/0065176 | A1 | 3/2013 | Momotani et al. |
| 2017/0176881 | A1 | 6/2017 | Okamoto et al. |

FOREIGN PATENT DOCUMENTS

| | | | |
|---|---|---|---|
| EP | 0 838 731 | A1 | 4/1998 |
| EP | 2 749 955 | A1 | 7/2014 |
| JP | 9-265213 | A | 10/1997 |
| JP | 10-254181 | A | 9/1998 |
| JP | 11-202563 | A | 7/1999 |
| JP | 2000-10355 | A | 1/2000 |
| JP | 2002-214849 | A | 7/2002 |
| JP | 2003-195573 | A | 7/2003 |
| JP | 2003-345071 | A | 12/2003 |
| JP | 2005-10528 | A | 1/2005 |
| JP | 2007-72166 | A | 3/2007 |
| JP | 2008-170564 | A | 7/2008 |
| JP | 2009-258590 | A | 11/2009 |
| JP | 2009-265596 | A | 11/2009 |
| JP | 2011-242457 | A | 12/2011 |
| JP | 2012-14091 | A | 1/2012 |
| JP | 2013-57890 | A | 3/2013 |
| JP | 2013-190657 | A | 9/2013 |
| JP | 2016-90843 | A | 5/2016 |
| WO | 95/08792 | A1 | 3/1995 |
| WO | WO 2015/119146 | A1 | 8/2015 |

OTHER PUBLICATIONS

Office Action dated Aug. 1, 2018 in Japanese Patent Application No. 2016-158696.
International Search Report dated Sep. 20, 2016 in PCT/JP2016/073753, 2 pages.
Office Action dated Oct. 9, 2018 issued in corresponding Japanese application 2016-158696.
Supplementary Search Report dated Feb. 18, 2019 issued in corresponding European patent application No. 16839119.1.

*Primary Examiner* — Mark A Chapman
(74) *Attorney, Agent, or Firm* — Oblon, McClelland, Maier & Neustadt, L.L.P.

(57) ABSTRACT

A liquid developer containing toner particles containing a resin containing a polyester and a pigment, wherein the toner particles are dispersed in an insulating liquid in the presence of a dispersant,
wherein the insulating liquid has a boiling point of 300° C. or lower, and wherein the insulating liquid has a peak intensity ratio of a methyl group calculated by the formula (1):

$$\text{Peak Intensity Ratio (\%) of Methyl Groups} = \frac{A}{A+B} \times 100 \quad (1)$$

wherein A is a peak intensity ascribed to $CH_3$ stretching vibration when measured with a Fourier transform infrared spectrometer, B is a total peak intensity ascribed to $CH_2$ stretching vibration and CH stretching vibration,
of 25% or more, or wherein the insulating liquid contains a polyisobutene.

16 Claims, No Drawings

LIQUID DEVELOPER

FIELD OF THE INVENTION

The present invention relates to a liquid developer usable in development of latent images formed in electrophotography, electrostatic recording method, electrostatic printing method or the like, and a method for producing the same.

BACKGROUND OF THE INVENTION

Electrophotographic developers are a dry developer in which toner components composed of materials containing a colorant and a resin binder are used in a dry state, and a liquid developer in which toner components are dispersed in an insulating liquid.

In a liquid developer, toner particles are dispersed in oil in an insulating liquid, thereby making it possible to form smaller particle sizes as compared to a dry developer. Therefore, high-quality printouts can be obtained surpassing offset printing, so that the liquid developer is suitable for commercial printing applications. In the recent years, with increasing demands for speeding up, the lowering of viscosities in the liquid developers has been desired.

In addition, in the recent years, with the increased awareness of environmental friendliness, an insulating liquid having a low volatility has been used as a dispersion medium for a liquid developer.

Patent Publication 1 discloses a recording material containing at least a poly-alpha-olefin as a non-aqueous dispersion medium, for the purpose of controlling, reducing etc. the generation of steam of a solvent in an electrophotographic liquid developer, clogging of nozzles due to evaporation of a solvent in an oily inkjet ink, odor or toxicity in a Magic Marker ink, odor of an insulating liquid in an electronic ink, or the like.

Patent Publication 2 discloses a liquid developer characterized in that supernatant of a liquid in which a colorant is dispersed in a carrier solvent has a transmittance of 60% or more over the entire region of wavelengths between 250 nm and 350 nm, for the purpose of providing a liquid developer in which excellent printouts are obtained with high reproducibility even after repeats of printouts, and a petroleum-based hydrocarbon solvent has been used as a preferred insulating solvent.

Patent Publication 1: Japanese Patent Laid-Open No. 2005-10528

Patent Publication 2: Japanese Patent Laid-Open No. Hei-11-202563

SUMMARY OF THE INVENTION

The present invention relates to:

[1] a liquid developer containing toner particles containing a resin containing a polyester and a pigment, wherein the toner particles are dispersed in an insulating liquid in the presence of a dispersant, wherein the above insulating liquid has a boiling point of 300° C. or lower, and wherein the insulating liquid has a peak intensity ratio of a methyl group calculated by the formula (1):

$$\text{Peak Intensity Ratio (\%) of Methyl Groups} = \frac{A}{A+B} \times 100 \quad (1)$$

wherein A is a peak intensity ascribed to $CH_3$ stretching vibration when measured with a Fourier transform infrared spectrometer, B is a total peak intensity ascribed to $CH_2$ stretching vibration and CH stretching vibration, of 25% or more;

[2] a liquid developer containing toner particles containing a resin containing a polyester and a pigment, wherein the toner particles are dispersed in an insulating liquid in the presence of a dispersant, wherein the above insulating liquid has a boiling point of 300° C. or lower, and wherein the insulating liquid contains a polyisobutene;

[3] use of an insulating liquid as a medium for a liquid developer, wherein the insulating liquid has a boiling point of 300° C. or lower, and wherein the insulating liquid has a peak intensity ratio of a methyl group calculated by the formula (1):

$$\text{Peak Intensity Ratio (\%) of Methyl Groups} = \frac{A}{A+B} \times 100 \quad (1)$$

wherein A is a peak intensity ascribed to $CH_3$ stretching vibration when measured with a Fourier transform infrared spectrometer, B is a total peak intensity ascribed to $CH_2$ stretching vibration and CH stretching vibration, of 25% or more;

[4] use of an insulating liquid that has a boiling point of 300° C. or lower, the insulating liquid containing a polyisobutene as a medium for a liquid developer;

[5] a method for producing a liquid developer containing toner particles containing a resin containing a polyester and a pigment, wherein the toner particles are dispersed in an insulating liquid in the presence of a dispersant, including:

step 1: melt-kneading a resin containing a polyester and a pigment, and pulverizing a kneaded product obtained, to provide toner particles;

step 2: adding a dispersant to the toner particles obtained in the step 1, and dispersing the toner particles in an insulating liquid to provide a dispersion of toner particles; and step 3: subjecting the dispersion of toner particles obtained in the step 2 to wet-milling, to provide a liquid developer, wherein the above insulating liquid has a boiling point of 300° C. or lower, and wherein the insulating liquid has a peak intensity ratio of a methyl group calculated by the formula (1):

$$\text{Peak Intensity Ratio (\%) of Methyl Groups} = \frac{A}{A+B} \times 100 \quad (1)$$

wherein A is a peak intensity ascribed to $CH_3$ stretching vibration when measured with a Fourier transform infrared spectrometer, B is a total peak intensity ascribed to $CH_2$ stretching vibration and CH stretching vibration, of 25% or more; and

[6] a method for producing a liquid developer containing toner particles containing a resin containing a polyester and a pigment, wherein the toner particles are dispersed in an insulating liquid in the presence of a dispersant, including:

step 1: melt-kneading a resin containing a polyester and a pigment, and pulverizing a kneaded product obtained, to provide toner particles;

step 2: adding a dispersant to the toner particles obtained in the step 1, and dispersing the toner particles in an insulating liquid to provide a dispersion of toner particles; and step 3: subjecting the dispersion of toner particles obtained in the step 2 to wet-milling, to provide a liquid developer, wherein the above insulating liquid has a boiling point of 300° C. or lower, and wherein the insulating liquid contains a polyisobutene.

DETAILED DESCRIPTION OF THE INVENTION

In the recent years, with increasing demands for speeding up, a toner which is melt-fusible in a smaller heat, i.e. a toner having excellent low-temperature fusing ability has been desired.

In order to improve low-temperature fusing ability, a method of using a low-boiling point insulating liquid has been considered. In the fusing step, toner particles are melt-fused on papers, while evaporating an insulating liquid which is a solvent for a liquid developer. By using an insulating liquid that has a low boiling point and is likely to evaporate, heat is more easily transmitted to the toner, and melting is accelerated, thereby making low-temperature fusing ability favorable.

On the other hand, a new problem that a printing apparatus halts by long-term operations in a liquid developer using a low-boiling point insulating liquid has been found.

In view of the above, after having reviewed on the causations thereof, the present inventors have elucidated that low-molecular weight components contained in the insulating liquid are evaporated, so that corona charger contamination caused by decomposition products or oxides or the like is generated, whereby consequently the printing apparatus halts by an electric short-circuit.

The present invention relates to a liquid developer that has excellent low-temperature fusing ability, and that further does not affect the printing apparatus even in long-term operations, and a method for producing the same.

The liquid developer of the present invention exhibits some effects that the liquid developer has excellent low-temperature fusing ability, and further would not affect the printing apparatus even in long-term operations.

The liquid developer of the present invention is a liquid developer containing toner particles containing a resin containing a polyester and a pigment, wherein the toner particles are dispersed in an insulating liquid in the presence of a dispersant, and the insulating liquid has a low boiling point, and contains methyl groups richly at the terminals. The liquid developer of the present invention containing the insulating liquid has excellent low-temperature fusing ability, so that some effects are exhibited that corona charger contamination can be controlled even in a long-term use, so that the printing apparatus is not affected at all.

Although the reasons why such effects are exhibited are not certain, they are considered to be as follows.

In the present invention, corona charger contamination refers to accumulation of organic compounds formed by decomposition or oxidation of low-molecular weight components contained in a trace amount in the insulating liquid on a wire surface of the charger provided in the vicinity of a photoconductive roller for charging a surface of a photoconductor. As a result of causation of corona charger contamination, errors such as electric short-circuits or operating halts of the printing apparatus (or not operating normally) are generated. It is considered that this decomposition or oxidation reaction is not caused by radicals derived from ozone generated upon corona discharge in the charger wire.

In the present invention since an insulating liquid richly containing methyl groups at the terminals is used, terminal methyl groups are likely to first react with the radicals to form unstable primary radicals, whereby making it less likely to proceed with the subsequent decomposition or oxidation reaction. For this reason, the corona charger contamination can be prevented even at a low boiling point.

Here, the presence or absence of this corona charger contamination can be judged by visually recognizing with visual observations or electron microphotographs of a wire surface. Alternatively, as described in Examples, the presence or absence can be judged from a change in surface potentials on a photoconductive roller when operated under specified environmental conditions. In other words, a large change in surface potentials can be assumed to have accumulated organic compounds mentioned above on a wire surface of the charger. Here, the presence or absence of the corona charger contamination by visual observations can be judged by the presence or absence of the adhesion of organic compounds on a cotton waste after wiping a wire surface with a cotton waste immersed in acetone.

In addition, since a low-boiling point insulating liquid is used, the toner is more likely to be thermally fused, thereby giving excellent low-temperature fusing ability.

[Resin]

The resin in the liquid developer of the present invention is a resin binder for toner particles. The resin contains a polyester, from the viewpoint of improving pulverizability of toner particles, thereby making it capable of forming smaller particle sizes, from the viewpoint of improving low-temperature fusing ability of the toner, and from the viewpoint of improving dispersion stability of the toner particles, thereby improving storage stability. The content of the polyester in the resin is preferably 90% by mass or more, more preferably 95% by mass or more, even more preferably substantially 100% by mass, and even more preferably 100% by mass, i.e. only the polyester is used as the resin. However, other resin besides the polyester may be contained within the range that would not impair the effects of the present invention. The resins besides the polyester include, for example, one or more members selected from resins such as styrenic resins which are homopolymers or copolymers containing styrene or styrene substitutes, such as polystyrenes, styrene-propylene copolymers, styrene-butadiene copolymers, styrene-vinyl chloride copolymers, styrene-vinyl acetate copolymers, styrene-maleic acid copolymers, styrene-acrylate ester copolymers, and styrene-methacrylate ester copolymers, epoxy resins, rosin-modified maleic acid resins, polyethylene-based resins, polypropylene-based resins, polyurethane-based resins, silicone resins, phenol resins, and aliphatic or alicyclic hydrocarbon resins.

In the present invention, it is preferable that the polyester is a polycondensate of an alcohol component containing a dihydric or higher polyhydric alcohol and a carboxylic acid component containing a dicarboxylic or higher polycarboxylic acid compound.

The dihydric alcohol includes, for example, diols having 2 or more carbon atoms and 20 or less carbon atoms, and preferably having 2 or more carbon atoms and 15 or less carbon atoms; an alkylene oxide adduct of bisphenol A represented by the formula (I):

(I)

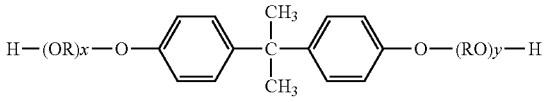

wherein RO and OR are an oxyalkylene group, wherein R is an ethylene group and/or a propylene group; and each of x and y is a positive number showing an average number of moles of alkylene oxide added, wherein a value of the sum of x and y is preferably 1 or more and 16 or less, more preferably 1 or more and 8 or less, even more preferably 1.5 or more and 6 or less, and even more preferably 1.5 or more and 4 or less; and the like.

Specific examples of the diol having 2 or more carbon atoms and 20 or less carbon atoms include ethylene glycol, 1,2-propanediol, 1,3-propanediol, 1,4-butanediol, 1,6-hexanediol, bisphenol A, hydrogenated bisphenol A, and the like.

The alcohol component is preferably 1,2-propanediol and an alkylene oxide adduct of bisphenol A represented by the formula (I), from the viewpoint of improving pulverizability of the toner, thereby obtaining a liquid developer having a smaller particle size, from the viewpoint of improving low-temperature fusing ability of the toner, and from the viewpoint of improving dispersion stability of the toner particles, thereby improving storage stability. The alkylene oxide adduct of bisphenol A represented by the formula (I) is more preferred, from the viewpoint of low-temperature fusing ability. The content of 1,2-propanediol or the alkylene oxide adduct of bisphenol A represented by the formula (I) in the alcohol component is preferably 50% by mol or more, more preferably 70% by mol or more, even more preferably 90% by mol or more, even more preferably substantially 100% by mol, and even more preferably 100% by mol. When 1,2-propanediol and the alkylene oxide adduct of bisphenol A represented by the formula (I) are used together, it is preferable that a total content of both is within the above range.

The trihydric or higher polyhydric alcohol includes trihydric or higher polyhydric alcohols having 3 or more carbon atoms and 20 or less carbon atoms, and preferably having 3 or more carbon atoms and 10 or less carbon atoms. Specific examples include sorbitol, 1,4-sorbitan, pentaerythritol, glycerol, trimethylolpropane, and the like.

The dicarboxylic acid compound includes, for example, dicarboxylic acids having 3 or more carbon atoms and 30 or less carbon atoms, preferably having 3 or more carbon atoms and 20 or less carbon atoms, and more preferably having 3 or more carbon atoms and 10 or less carbon atoms, or anhydrides thereof, derivatives thereof such as alkyl esters of which alkyl has 1 or more carbon atoms and 3 or less carbon atoms, and the like. Specific examples include aromatic dicarboxylic acids such as phthalic acid, isophthalic acid, and terephthalic acid; and aliphatic dicarboxylic acids such as fumaric acid, maleic acid, succinic acid, glutaric acid, adipic acid, sebacic acid, and succinic acid substituted with an alkyl group having 1 or more carbon atoms and 20 or less carbon atoms or an alkenyl group having 2 or more carbon atoms and 20 or less carbon atoms.

The tricarboxylic or higher polycarboxylic acid compound includes, for example, tricarboxylic or higher polycarboxylic acids having 4 or more carbon atoms and 20 or less carbon atoms, preferably having 6 or more carbon atoms and 20 or less carbon atoms, more preferably having 8 or more carbon atoms and 15 or less carbon atoms, and even more preferably having 9 or more carbon atoms and 10 or less carbon atoms, or acid anhydrides thereof, derivatives thereof such as alkyl esters of which alkyl has 1 or more carbon atoms and 3 or less carbon atoms and the like. Specific examples include 1,2,4-benzenetricarboxylic acid (trimellitic acid), 1,2,4,5-benzenetetracarboxylic acid (pyromellitic acid), and the like.

The carboxylic acid component is preferably terephthalic acid or fumaric acid, and more preferably terephthalic acid, from the viewpoint of improving low-temperature fusing ability of the toner, and from the viewpoint of improving dispersion stability of the toner particles, thereby improving storage stability. The content of the terephthalic acid is preferably 50% by mol or more, more preferably 70% by mol or more, even more preferably 90% by mol or more, even more preferably substantially 100% by mol, and even more preferably 100% by mol, of the carboxylic acid component.

Here, the alcohol component may contain a monohydric alcohol, and the carboxylic acid component may contain a monocarboxylic acid compound in proper amounts, from the viewpoint of adjusting a molecular weight and a softening point of the polyester.

The equivalent ratio of the carboxylic acid component to the alcohol component in the polyester, i.e. COOH group or groups/OH group or groups, is preferably 0.70 or more, more preferably 0.73 or more, and even more preferably 0.75 or more, and preferably 1.10 or less, more preferably 1.05 or less, and even more preferably 1.00 or less, from the viewpoint of adjusting a softening point of the polyester.

The polyester can be produced, for example, by polycondensing the alcohol component and the carboxylic acid component in an inert gas atmosphere at a temperature of 130° C. or higher and 250° C. or lower, and preferably 200° C. or higher and 250° C. or lower, optionally in the presence of an esterification catalyst, an esterification promoter, a polymerization inhibitor or the like.

The esterification catalyst includes tin compounds such as dibutyltin oxide and tin(II) 2-ethylhexanoate; titanium compounds such as titanium diisopropylate bistriethanolaminate; and the like, and dibutyltin oxide is preferred. The amount of the esterification catalyst used is preferably 0.01 parts by mass or more, and more preferably 0.1 parts by mass or more, and preferably 1.5 parts by mass or less, and more preferably 1.0 part by mass or less, based on 100 parts by mass of a total amount of the alcohol component and the carboxylic acid component. The esterification promoter includes gallic acid, and the like. The amount of the esterification promoter used is preferably 0.001 parts by mass or more, and more preferably 0.01 parts by mass or more, and preferably 0.5 parts by mass or less, and more preferably 0.1 parts by mass or less, based on 100 parts by mass of a total amount of the alcohol component and the carboxylic acid component. The polymerization inhibitor includes t-butyl catechol, and the like. The amount of the polymerization inhibitor used is preferably 0.001 parts by mass or more, and more preferably 0.01 parts by mass or more, and preferably 0.5 parts by mass or less, and more preferably 0.1 parts by mass or less, based on 100 parts by mass of a total amount of the alcohol component and the carboxylic acid component.

The softening point of the polyester is preferably 160° C. or lower, more preferably 130° C. or lower, even more preferably 120° C. or lower, even more preferably 110° C. or lower, and even more preferably 100° C. or lower, from the viewpoint of improving low-temperature fusing ability of the toner, and the softening point is preferably 70° C. or higher, more preferably 75° C. or higher, and even more preferably 80° C. or higher, from the viewpoint of improving dispersion stability of the toner particles, thereby improving storage stability.

The glass transition temperature of the polyester is preferably 80° C. or lower, more preferably 70° C. or lower, and even more preferably 60° C. or lower, from the viewpoint of improving low-temperature fusing ability, and the glass transition temperature is preferably 40° C. or higher, and more preferably 45° C. or higher, from the viewpoint of improving dispersion stability of the toner particles, thereby improving storage stability.

From the viewpoint of lowering a viscosity of the liquid developer, and from the viewpoint of improving dispersion stability of the toner particles, thereby improving storage stability, the acid value of the polyester is preferably 110 mgKOH/g or less, more preferably 70 mgKOH/g or less, even more preferably 50 mgKOH/g or less, even more preferably 30 mgKOH/g or less, even more preferably 20 mgKOH/g or less, and even more preferably 12 mgKOH/g or less, and the acid value is preferably 1 mgKOH/g or more, more preferably 3 mgKOH/g or more, and even more preferably 5 mgKOH/g or more. The acid value of the polyester can be adjusted by a method such as varying an equivalent ratio of the carboxylic acid component to the alcohol component, varying a reaction time during the production of the resin, or varying the content of the tricarboxylic or higher polycarboxylic acid compound.

In the present invention, the polyester resin refers to a resin containing a polyester unit formed by polycondensation of the alcohol component and the carboxylic acid component. The polyester resin includes a polyester, a polyester-polyamide, a composite resin having two or more kinds of resin components including a polyester component, for example, a hybrid resin in which a polyester component and an addition polymerization-based resin component are partially chemically bonded via a dually reactive monomer, and the like. The content of the polyester unit is preferably 60% by mass or more, more preferably 80% by mass or more, even more preferably 90% by mass or more, and even more preferably 95% by mass or more, and preferably 100% by mass or less, and more preferably 100% by mass, of the polyester resin.

Here, in the present invention, the polyester may be a modified polyester to an extent that the properties thereof are not substantially impaired. The modified polyester includes, for example, a polyester grafted or blocked with a phenol, a urethane, an epoxy or the like according to a method described in Japanese Patent Laid-Open No. Hei-11-133668, Hei-10-239903, Hei-8-20636, or the like.

[Pigment]

As the pigment, all the pigments which are used as colorants for toners can be used, and carbon blacks, Phthalocyanine Blue, Permanent Brown F G, Brilliant Fast Scarlet, Pigment Green B, Rhodamine-B Base, Solvent Red 49, Solvent Red 146, Solvent Blue 35, quinacridone, carmine 6B, isoindoline, disazo yellow, or the like can be used. In the present invention, the toner particles may be any one of black toners and color toners.

The content of the pigment is preferably 100 parts by mass or less, more preferably 70 parts by mass or less, even more preferably 50 parts by mass or less, even more preferably 30 parts by mass or less, and even more preferably 25 parts by mass or less, based on 100 parts by mass of the resin, from the viewpoint of improving pulverizability of the toner particles, thereby making it possible to form smaller particle sizes, from the viewpoint of improving low-temperature fusing ability, and from the viewpoint of improving dispersion stability of the toner particles, thereby improving storage stability, and the content is preferably 5 parts by mass or more, more preferably 10 parts by mass or more, and even more preferably 15 parts by mass or more, based on 100 parts by mass of the resin, from the viewpoint of improving optical density.

In the present invention, as toner raw materials, an additive such as a releasing agent, a charge control agent, a charge control resin, a magnetic particulate, a fluidity improver, an electric conductivity modifier, a reinforcing filler such as a fibrous material, an antioxidant, or a cleanability improver may be further properly used.

[Method for Producing Toner Particles]

The method for obtaining toner particles includes a method including melt-kneading toner raw materials containing a resin and a pigment, and pulverizing the melt-kneaded product obtained to provide toner particles; a method including mixing an aqueous resin dispersion and an aqueous pigment dispersion, thereby unifying the resin particles and the pigment particles; a method including stirring an aqueous resin dispersion and a pigment at a high speed; and the like. The method including melt-kneading toner raw materials, and pulverizing the melt-kneaded product obtained is preferred, from the viewpoint of improving developing ability and fusing ability.

It is preferable that the toner raw materials containing a resin and a pigment are previously mixed with a mixer such as a Henschel mixer, a Super mixer or a ball-mill, and the mixture is then fed to a kneader, and the Henschel mixer is more preferred, from the viewpoint of improving pigment dispersibility in the resin.

The mixing with a Henschel mixer is carried out by adjusting a peripheral speed of agitation, and a mixing time. The peripheral speed is preferably 10 m/sec or more and 30 m/sec or less, from the viewpoint of improving pigment dispersibility. In addition, the agitation time is preferably 1 minute or more and 10 minutes or less, from the viewpoint of improving pigment dispersibility.

Next, the melt-kneading of toner raw materials can be carried out with a known kneader, such as a tightly closed kneader, a single-screw or twin-screw kneader, or a continuous open-roller type kneader. In the method for production of the present invention, an open-roller type kneader is preferred, from the viewpoint of improving pigment dispersibility, and from the viewpoint of improving an yield of the toner particles after pulverization.

The open-roller type kneader refers to a kneader of which melt-kneading unit is an open type, not being tightly closed, which can easily dissipate the kneading heat generated during the melt-kneading. The open-roller type kneader used in the present invention is provided with a plurality of feeding ports for raw materials and a discharging port for a kneaded mixture along the shaft direction of the roller, and it is preferable that the open-roller type kneader is a continuous open-roller type kneader, from the viewpoint of production efficiency.

It is preferable that the open-roller type kneader comprises at least two kneading rollers having different temperatures. The temperature of the roller can be adjusted by, for example, a temperature of a heating medium passing through the inner portion of the roller, and each roller may be divided in two or more portions in the inner portion of the roller, each being passed through with heating media of different temperatures.

It is preferable that the setting temperatures of the rollers are such that the set temperature is equal to or lower than a temperature that is 10° C. higher than the softening point of the resin, from the viewpoint of improving miscibility of the toner raw materials.

It is preferable that the set temperature of the roller at an upstream side is higher than the set temperature of the roller at a downstream side, from the viewpoint of making the adhesiveness of the kneaded product to the roller at an upstream side favorable and strongly kneading at a downstream side.

It is preferable that the rollers have peripheral speeds that are different from each other. In the open roller-type kneader provided with the above two rollers, it is preferable that the heat roller having a higher temperature is a high-rotation roller, and that the cooling roller having a lower temperature is a low-rotation roller, from the viewpoint of improving fusing ability of the liquid developer.

The peripheral speed of the high-rotation roller is preferably 2 m/min or more, and more preferably 5 m/min or more, and preferably 100 m/min or less, and more preferably 75 m/min or less. Also, the ratio of the peripheral speeds of the two rollers, i.e. low-rotation roller/high-rotation roller, is preferably from 1/10 to 9/10, and more preferably from 3/10 to 8/10.

The gap between the two rollers, i.e. clearance, at an end part on the upstream side of the kneading is preferably 0.1 mm or more, and the gap is preferably 3 mm or less, and more preferably 1 mm or less.

In addition, structures, size, materials and the like of each of the rollers are not particularly limited. The surface of the roller comprises a groove used in kneading, and the shapes of grooves include linear, spiral, wavy, rugged or other forms.

The feeding rates and the average residence time of the raw material mixture differ depending upon the size of the rollers used, components of the raw materials, and the like, so that optimal conditions among these conditions may be selected.

Next, the kneaded product is cooled to an extent that is pulverizable, and the cooled product is subjected to a pulverizing step and optionally a classifying step, whereby the toner particles can be obtained.

The pulverizing step may be carried out in divided multi-stages. For example, the melt-kneaded product may be roughly pulverized to a size of from 1 to 5 mm or so, and the roughly pulverized product may then be further finely pulverized. In addition, in order to improve productivity during the pulverizing step, the melt-kneaded product may be mixed with fine inorganic particles made of hydrophobic silica or the like, and then pulverized.

The pulverizer suitably used in the rough pulverization includes an atomizer, Rotoplex, and the like, or a hammer-mill or the like may be used. The pulverizer suitably used in the fine pulverization includes a fluidised bed opposed jet mill, an air jet mill, a rotary mechanical mill, and the like.

The classifier usable in the classification step includes an air classifier, a rotor type classifier, a sieve classifier, and the like. Here, the pulverizing step and the classifying step may be repeated as occasion demands.

The toner particles obtained in this step have a volume-median particle size $D_{50}$ of preferably 3 μm or more, and more preferably 4 μm or more, and preferably 15 μm or less, and more preferably 12 μm or less, from the viewpoint of improving productivity of the wet-milling step described later. Here, the volume-median particle size $D_{50}$ means a particle size of which cumulative volume frequency calculated on a volume percentage is 50% counted from the smaller particle sizes.

[Method for Producing Liquid Developer]

The toner particles are dispersed in an insulating liquid in the presence of a dispersant to provide a liquid developer.

The method for producing a liquid developer includes a method including melt-kneading and pulverizing a resin and a pigment, and subjecting toner particles obtained to wet-milling in an insulating liquid; a coarcervation method including removing the solvent from a liquid mixture of a pigment and a resin, a solvent dissolving the resin, and an insulating liquid to precipitate pigment-containing particles, and the like. The method of wet-milling is preferred, from the viewpoint of enhancing adsorbability of a dispersant by making the shapes of the toner particles heteromorphous in a liquid developer, thereby improving dispersibility and chargeability of the toner particles.

[Insulating Liquid]

The insulating liquid means a liquid through which electricity is less likely to flow, and in the present invention, the conductivity of the insulating liquid is preferably $1.0\times10^{-11}$ S/m or less, and more preferably $5.0\times10^{-12}$ S/m or less, and preferably $1.0\times10^{-13}$ S/m or more. In addition, it is preferable that the dielectric constant of the insulating liquid is 3.5 or less.

The insulating liquid in the liquid developer of the present invention, as mentioned above, has a low boiling point, and richly contains methyl groups at the terminals, and a first embodiment of the insulating liquid is an insulating liquid which has a boiling point of 300° C. or lower, and the insulating liquid has a peak intensity ratio of a methyl group calculated by the formula (1):

$$\text{Peak Intensity Ratio (\%) of Methyl Groups} = \frac{A}{A+B}\times 100 \quad (1)$$

wherein A is a peak intensity ascribed to $CH_3$ stretching vibration when measured with a Fourier transform infrared spectrometer, B is a total peak intensity ascribed to $CH_2$ stretching vibration and CH stretching vibration, of 25% or more.

The peak intensity ascribed to a $CH_3$ stretching vibration appears near 2,960 $cm^{-1}$, and the peak intensities ascribed to a $CH_2$ stretching vibration and a CH stretching vibration appear near from 2,850 to 2,930 $cm^{-1}$, respectively. However, when there are plural peaks, the intensity is a total of all the peaks.

The peak intensity ratio of methyl groups calculated from the formula (1) is 25% or more, preferably 30% or more, and more preferably 35% or more, and the peak intensity ratio is preferably 65% or less, more preferably 60% or less, and even more preferably 55% or less, from the viewpoint of improving dispersion stability of the toner particles, thereby improving storage stability.

The insulating liquid having a peak intensity ratio of methyl groups calculated from the formula (1) of 25% or more includes, for example, hydrocarbons richly containing methyl groups at the terminals, and specific examples include polyisobutene, and the like.

In addition, as to the insulating liquid, a further aspect is provided. In other words, a second embodiment of the insulating liquid in the liquid developer of the present invention is an insulating liquid which has a boiling point of 300° C. or lower, and the insulating liquid contains a polyisobutene.

The polyisobutene in the present invention refers to a compound obtained by polymerizing isobutene in accordance with a known method, for example, a cationic polymerization method using a catalyst, and thereafter hydrogenating the polymer at a terminal double bond.

The catalyst usable in the cationic polymerization method includes, for example, aluminum chloride, an acidic ion-exchanging resin, sulfuric acid, boron fluoride, and complexes thereof, and the like. In addition, the polymerization reaction can be controlled by adding a base to the above catalyst.

The degree of polymerization of the polyisobutene is preferably 8 or less, more preferably 6 or less, even more preferably 5 or less, even more preferably 4 or less, and even more preferably 3 or less, from the viewpoint of improving low-temperature fusing ability of the toner, and the degree of polymerization is preferably 2 or more, and more preferably 3 or more, from the viewpoint of controlling corona charger contamination.

It is preferable that an unreacted component of isobutene caused during the polymerization reaction or a high-boiling point component having a high degree of polymerization is removed by distillation. The method of distillation includes, for example, a simple distillation method, a continuous distillation method, a steam distillation method, and the like, and these methods can be used alone or in a combination. The apparatuses used in distillation are not particularly limited to in materials, shapes, models, and the like, which include a distillation tower packed with a filler material such as Raschig ring, shelved distillation towers comprising dish-shaped shelves, and the like. In addition, the theoretical number of shelves showing separating ability of the distillation tower is preferably 10 shelves or more. Besides, as to conditions such as feeding rates to the distillation tower, refluxing ratios, and uptake amounts, the conditions can be appropriately selected depending upon the distillation apparatuses.

Since a formed product obtained by the polymerization reaction has a double bond at a polymerization terminal, a hydrogenated compound is obtained by a hydrogenation reaction. The hydrogenation reaction can be carried out by, for example, contacting with hydrogen under a pressure of from 2 to 10 MPa at a temperature of from 180° to 230° C. using a hydrogenation catalyst such as nickel or palladium.

The content of the polyisobutene is preferably 5% by mass or more, more preferably 20% by mass or more, even more preferably 40% by mass or more, even more preferably 60% by mass or more, and even more preferably 80% by mass or more, of the insulating liquid, from the viewpoint of controlling corona charger contamination.

Commercially available products of the insulating liquid containing a polyisobutene include "NAS-3," "NAS-4," "NAS-5H," hereinabove manufactured by NOF Corporation, and the like. Among them, the commercially available products can be used alone or in a combination of two or more kinds.

Specific examples of the insulating liquid other than the polyisobutene include, for example, aliphatic hydrocarbons, alicyclic hydrocarbons, aromatic hydrocarbons, halogenated hydrocarbons, polysiloxanes, vegetable oils, and the like. Among them, the aliphatic hydrocarbons such as liquid paraffin and isoparaffin are preferred, from the viewpoint of lowering the viscosity of the liquid developer, and from the viewpoint of odor, harmlessness, and costs.

Commercially available products of the aliphatic hydrocarbon include Isopar M manufactured by Exxon Mobile Corporation; Lytol, manufactured by Sonneborn; Cactus N12D and Cactus N14 manufactured by JX Nippon Oil & Energy Corporation, and the like.

In both of the first embodiment and the second embodiment, the boiling point of the insulating liquid is preferably 120° C. or higher, more preferably 140° C. or higher, even more preferably 160° C. or higher, even more preferably 180° C. or higher, even more preferably 200° C. or higher, and even more preferably 220° C. or higher, from the viewpoint of even more improving dispersion stability of the toner particles, thereby improving storage stability, and the boiling point is 300° C. or lower, preferably 280° C. or lower, and more preferably 260° C. or lower, from the viewpoint of even more improving low-temperature fusing ability of the toner, and from the viewpoint of even more improving pulverizability of the toner during wet-milling, thereby providing a liquid developer having a smaller particle size. When the insulating liquids are used in combination of two or more kinds, it is preferable that a boiling point of a combined insulating liquid mixture is within the above range.

In both of the first embodiment and the second embodiment, the viscosity of the insulating liquid at 25° C. is preferably 0.01 mPa·s or more, more preferably 0.3 mPa·s or more, even more preferably 0.5 mPa·s or more, and even more preferably 0.7 mPa·s or more, from the viewpoint of improving dispersion stability of the toner particles, thereby even more improving storage stability, and the viscosity is preferably 15 mPa·s or less, more preferably 10 mPa·s or less, even more preferably 5 mPa·s or less, even more preferably 4 mPa·s or less, and even more preferably 3 mPa·s or less, from the viewpoint of even more improving low-temperature fusing ability, and from the viewpoint of even more improving pulverizability of the toner during wet-milling, thereby providing a liquid developer having a smaller particle size. When the insulating liquids are used in combination of two or more kinds, it is preferable that a viscosity of a combined insulating liquid mixture is within the above range.

The content of the toner particles, based on 100 parts by mass of the insulating liquid, is preferably 10 parts by mass or more, more preferably 20 parts by mass or more, even more preferably 30 parts by mass or more, and even more preferably 40 parts by mass or more, from the viewpoint of high-speed printing ability, and the content is preferably 100 parts by mass or less, more preferably 80 parts by mass or less, and even more preferably 65 parts by mass or less, from the viewpoint of improving dispersion stability.

In addition, the present invention relates to use of an insulating liquid of a first embodiment or a second embodiment, as a medium for a liquid developer.

[Dispersant]

The liquid developer of the present invention contains a dispersant, from the viewpoint of improving dispersion stability of the toner particles, thereby improving storage stability, and from the viewpoint of improving pulverizability of the toner particles during wet-milling, thereby obtaining a liquid developer having a smaller particle size. The dispersant is used for stably dispersing the toner particles in an insulating liquid. It is preferable that the liquid developer of the present invention contains a basic dispersant having a basic adsorbing group, from the viewpoint of improving adsorbability to the resin, particularly the polyester. It is preferable that the basic adsorbing group is at least one nitrogen-containing group selected from the group consisting of amino groups (—$NH_2$, —NHR, —NHRR'), an imino group (═NH), an amide group (C(═O)—NRR'), an imide group (—$N(COR)_2$), a nitro group (—$NO_2$), a cyano group (—CN), an azo group (—N═N—), a diazo group (═$N_2$), and an azide group (—$N_3$), from the viewpoint of positive chargeability of the toner. Here, each of R and R' stands for a hydrocarbon group having from 1 to 5 carbon atoms. The amino groups or imino group is preferred, from the viewpoint of adsorbability of the dispersant to the toner particles, and the imino group is more preferred, from the viewpoint of increasing adsorption efficiency of the dispersant, and from the viewpoint of controlling aggregation of the toner particles, thereby lowering a viscosity of the liquid developer. The basic dispersant preferably has plural basic adsorbing groups, and a basic dispersant having an imino group is preferably a condensate of a polyimine and a carboxylic acid.

As the polyimine, a polyalkyleneimine is preferred, from the viewpoint of improving dispersion stability of the toner particles, thereby improving storage stability. Specific examples include polyethyleneimine, polypropyleneimine, polybutyleneimine, and the like, and the polyethyleneimine is more preferred, from the viewpoint of improving dispersion stability of the toner particles, thereby improving storage stability. The number of moles of ethyleneimine added is preferably 10 or more, and more preferably 100 or more, and preferably 1,000 or less, and more preferably 500 or less.

On the other hand, the carboxylic acid is preferably a saturated or unsaturated aliphatic carboxylic acid, and more preferably a linear, saturated or unsaturated aliphatic carboxylic acid, having preferably 10 or more carbon atoms and 30 or less carbon atoms, more preferably 12 or more carbon atoms and 24 or less carbon atoms, and even more preferably 16 or more carbon atoms and 22 or less carbon atoms, from the viewpoint of improving dispersion stability of the toner particles, thereby improving storage stability. Specific carboxylic acids include linear saturated aliphatic carboxylic acids such as lauric acid, myristic acid, palmitic acid, and stearic acid; linear unsaturated aliphatic carboxylic acids such as oleic acid, linoleic acid, and linolenic acid; and the like.

Also, the carboxylic acid may have a substituent such as a hydroxy group. A hydroxycarboxylic acid having a hydroxy group as a substituent is preferred, from the viewpoint of improving dispersion stability of the toner particles, thereby improving storage stability. The hydroxycarboxylic acid includes hydroxycarboxylic acids such as mevalonic acid, ricinoleic acid, and 12-hydroxystearic acid, and the like. The hydroxycarboxylic acid may be a condensate thereof.

From the above viewpoint, the carboxylic acid is preferably a hydroxyaliphatic carboxylic acid having preferably 10 or more carbon atoms and 30 or less carbon atoms, more preferably 12 or more carbon atoms and 24 or less carbon atoms, and even more preferably 16 or more carbon atoms and 22 or less carbon atoms, or a condensate thereof, and more preferably 12-hydroxystearic acid or a condensate thereof.

Specific examples of the condensate include SOLSPARSE 11200 (amine value calculated as 100% effective ingredient: 64 mgKOH/g) and SOLSPARSE 13940 (amine value calculated as 100% effective ingredient: 130 mgKOH/g), hereinabove both manufactured by Lubrizol Corporation, and the like, and SOLSPARSE 11200 is preferred.

The weight-average molecular weight of the condensate is preferably 2,000 or more, more preferably 4,000 or more, and even more preferably 8,000 or more, from the viewpoint of improving dispersion stability of the toner particles, thereby improving storage stability, and the weight-average molecular weight is preferably 50,000 or less, more preferably 40,000 or less, even more preferably 30,000 or less, even more preferably 20,000 or less, and even more preferably 15,000 or less, from the viewpoint of pulverizability of the toner.

The amine value of the condensate is preferably 20 mgKOH/g or more, more preferably 30 mgKOH/g or more, even more preferably 40 mgKOH/g or more, and even more preferably 50 mgKOH/g or more, from the viewpoint of improving dispersion stability of the toner particles, thereby improving storage stability, and the amine value is preferably 150 mgKOH/g or less, more preferably 120 mgKOH/g or less, and even more preferably 100 mgKOH/g or less, from the viewpoint of improving developing ability of the liquid developer.

The content of the dispersant as an effective ingredient, based on 100 parts by mass of the toner particles, is preferably 0.5 parts by mass or more, more preferably 1 part by mass or more, and even more preferably 2 parts by mass or more, from the viewpoint of controlling the aggregation of the toner particles, thereby lowering the viscosity of the liquid developer, and the content is preferably 20 parts by mass or less, more preferably 15 parts by mass or less, even more preferably 10 parts by mass or less, and even more preferably 5 parts by mass or less, from the viewpoint of improving developing ability and fusing ability.

In addition, the content of the condensate in the dispersant is preferably 50% by mass or more, more preferably 70% by mass or more, even more preferably 90% by mass or more, even more preferably substantially 100% by mass, and even more preferably 100% by mass, from the viewpoint of controlling the aggregation of the toner particles, thereby lowering the viscosity of the liquid developer, and from the viewpoint of improving pulverizability of the toner particles during wet-milling, thereby obtaining a liquid developer having a smaller particle size.

The dispersant other than the condensate of a polyimine and a carboxylic acid includes copolymers of alkyl methacrylate/amino group-containing methacrylate, copolymers of α-olefin/vinyl pyrrolidone (Antaron V-216), and the like.

It is preferable that a method for mixing toner particles, an insulating liquid, and a dispersant is a method including stirring the components with an agitation mixer, or the like.

The agitation mixer is, but not particularly limited to, preferably high-speed agitation mixers, from the viewpoint of improving productivity and storage stability of the dispersion of toner particles. Specific examples are preferably DESPA manufactured by ASADA IRON WORKS CO., LTD.; T.K. HOMOGENIZING MIXER, T.K. HOMOGENIZING DISPER, T.K. ROBOMIX, hereinabove manufactured by PRIMIX Corporation; CLEARMIX manufactured by M Technique Co., Ltd.; KADY Mill manufactured by KADY International, and the like.

The toner particles are previously dispersed by mixing components with a high-speed agitation mixer, whereby a dispersion of toner particles can be obtained, which in turn improves productivity of a liquid developer by the subsequent wet-milling.

The solid content concentration of the dispersion of toner particles is preferably 20% by mass or more, more preferably 30% by mass or more, and even more preferably 33% by mass or more, from the viewpoint of improving optical density, and the solid content concentration is preferably 50% by mass or less, more preferably 45% by mass or less, and even more preferably 40% by mass or less, from the viewpoint of improving dispersion stability of the toner particles, thereby improving storage stability.

[Wet-Milling]

It is preferable that the toner particles are dispersed in an insulating liquid, and the dispersion is subjected to wet-milling to provide a liquid developer, from the viewpoint of making particle sizes of the toner particles smaller in the liquid developer, and from the viewpoint of lowering a viscosity of the liquid developer.

The wet-milling refers to a method of subjecting toner particles dispersed in an insulating liquid to a mechanical milling treatment in the state of dispersion in the insulating liquid.

As the apparatus used, for example, generally used agitation mixers such as anchor blades can be used. The agitation mixers include high-speed agitation mixers such as DESPA manufactured by ASADA IRON WORKS CO., LTD., and T.K. HOMOGENIZING MIXER manufactured by PRIMIX Corporation; pulverizers and kneaders, such as roller mills, beads-mills, kneaders, and extruders; and the like. These apparatuses can be used in a combination of plural apparatuses.

Among these apparatuses, use of beads-mill is preferred, from the viewpoint of making particle sizes of toner particles smaller, from the viewpoint of improving dispersion stability of the toner particles, thereby improving storage stability, and from the viewpoint of lowering the viscosity of the dispersion.

By controlling particle sizes and filling ratios of media used, peripheral speeds of rotors, residence time, or the like in the beads-mill, toner particles having a desired particle size and a particle size distribution can be obtained.

The materials for the media include, for example, high-hardness metals such as steel and chromium alloys; high-hardness ceramics such as alumina, zirconia, zircon, and titania; polymer materials such as ultra-high molecular weight polyethylenes and nylon; and the like.

The sizes of the shearing force, impact force, and pulverization force for finely powdering the toner particles becomes greater with an increase in specific gravity of the media particles. Therefore, among these materials, ceramic media having relatively large specific gravities are preferred, and zirconia is more preferred from the viewpoint of wear resistance.

As the particle size (diameter) of the media, those of desired sizes can be used. The larger the particle size of the media, the larger the kinetic energy per single medium, thereby making a pulverization force favorably larger. On the other hand, the smaller the particle sizes of the media particles, the more increased the number of contact points of the media with another media, thereby making dispersion frequency favorably larger. In other words, there exists an optimal range for the media diameter, and the particle size of the media is preferably from 0.2 to 1.5 mm, and more preferably from 0.2 to 1.0 mm.

The peripheral speed of a tip end of the rotor is, but not particularly limited to, preferably 4 m/s or more, and more preferably 4.5 m/s or more. When the peripheral speed is 4.5 m/s or more, the mixing dispersion state within the dispersion chamber can be favorably maintained. It is preferable that the volume filling ratio of the media particles is within the range of from 50 to 100% by volume, on the basis of the space inside the dispersion chamber. When the volume filling ratio is 50% by volume or less, the effects of pulverization, shearing or impact by the media are reduced, thereby reducing the dispersion effects of a pigment.

As mentioned above, it is preferable that the liquid developer of the present invention is produced by a method including:

step 1: melt-kneading a resin containing a polyester and a pigment, and pulverizing a kneaded product, to provide toner particles;

step 2: adding a dispersant to the toner particles obtained in the step 1, and dispersing the toner particles in a particular insulating liquid to provide a dispersion of toner particles; and step 3: subjecting the dispersion of toner particles obtained in the step 2 to wet-milling, to provide a liquid developer.

The solid content concentration of the liquid developer is preferably 10% by mass or more, more preferably 15% by mass or more, and even more preferably 20% by mass or more, from the viewpoint of improving optical density, and the solid content concentration is preferably 50% by mass or less, more preferably 45% by mass or less, and even more preferably 40% by mass or less, from the viewpoint of improving dispersion stability of toner particles, thereby improving storage stability.

The volume-median particle size $D_{50}$ of the toner particles in the liquid developer is preferably 5 μm or less, more preferably 3 μm or less, and even more preferably 2.5 μm or less, from the viewpoint of improving image quality of the liquid developer, and the volume median particle size is preferably 0.5 μm or more, more preferably 1.0 μm or more, and even more preferably 1.5 μm or more, from the viewpoint of lowering the viscosity of the liquid developer.

The average circularity of the toner particles in the liquid developer is preferably 0.85 or more, more preferably 0.87 or more, even more preferably 0.88 or more, even more preferably 0.89 or more, and even more preferably 0.90 or more, from the viewpoint of improving fusing ability, and the average circularity is preferably 0.98 or less, more preferably 0.97 or less, even more preferably 0.96 or less, even more preferably 0.95 or less, and even more preferably 0.94 or less, from the viewpoint of increasing adsorbability of the dispersant, thereby improving dispersibility and chargeability of the toner particles. The average circularity is an index showing the degree of ruggedness of the surface of the toner particles, where a circularity in a case where a toner is a perfect sphere, i.e. an upper limit of the average circularity, is 1.0. On the other hand, the larger the ruggedness of the surface of the particles, the smaller the value of the circularity.

The viscosity of the liquid developer at 25° C. is preferably 50 mPa·s or less, more preferably 40 mPa·s or less, even more preferably 37 mPa·s or less, even more preferably 35 mPa·s or less, even more preferably 32 mPa·s or less, even more preferably 28 mPa·s or less, even more preferably 26 mPa·s or less, even more preferably 24 mPa·s or less, even more preferably 22 mPa·s or less, and even more preferably 19 mPa·s or less, from the viewpoint of improving fusing ability of the liquid developer. Also, the viscosity is preferably 3 mPa·s or more, more preferably 5 mPa·s or more, even more preferably 6 mPa·s or more, and even more preferably 7 mPa·s or more, from the viewpoint of improving dispersion stability of the toner particles, thereby improving storage stability.

With regard to the embodiments described above, the present invention further discloses the following liquid developer and the method for producing the same.

<1> A liquid developer containing toner particles containing a resin containing a polyester and a pigment, wherein the toner particles are dispersed in an insulating liquid in the presence of a dispersant, wherein the above insulating liquid has a boiling point of 300° C. or lower, and wherein the insulating liquid has a peak intensity ratio of a methyl group calculated by the formula (1) of 25% or more.

<2> A liquid developer containing toner particles containing a resin containing a polyester and a pigment, wherein the toner particles are dispersed in an insulating liquid in the presence of a dispersant, wherein the above insulating liquid has a boiling point of 300° C. or lower, and wherein the insulating liquid contains a polyisobutene.

<3> The liquid developer according to the above <1> or <2>, wherein the content of the polyester in the resin is 90% by mass or more, preferably 95% by mass or more, more preferably substantially 100% by mass, and even more preferably 100% by mass, i.e. the resin is composed only of the polyester.

<4> The liquid developer according to any one of the above <1> to <3>, wherein the polyester is a polycondensate of an alcohol component containing a dihydric or higher polyhydric alcohol and a carboxylic acid component containing a dicarboxylic or higher polycarboxylic acid compound.

<5> The liquid developer according to the above <4>, wherein the alcohol component contains 1,2-propanediol or an alkylene oxide adduct of bisphenol A represented by the formula (I), and preferably contains the alkylene oxide adduct of bisphenol A represented by the formula (I).

<6> The liquid developer according to the above <5>, wherein the content of 1,2-propanediol or the alkylene oxide adduct of bisphenol A represented by the formula (I) in the alcohol component is 50% by mol or more, preferably 70% by mol or more, more preferably 90% by mol or more, even more preferably substantially 100% by mol, and even more preferably 100% by mol.

<7> The liquid developer according to any one of the above <4> to <6>, wherein the carboxylic acid component contains terephthalic acid or fumaric acid, and preferably contains terephthalic acid.

<8> The liquid developer according to the above <7>, wherein the content of the terephthalic acid is 50% by mol or more, preferably 70% by mol or more, more preferably 90% by mol or more, even more preferably substantially 100% by mol, and even more preferably 100% by mol, of the carboxylic acid component.

<9> The liquid developer according to any one of the above <1> to <8>, wherein the softening point of the polyester is 70° C. or higher, preferably 75° C. or higher, and more preferably 80° C. or higher, and the softening point is 160° C. or lower, preferably 130° C. or lower, more preferably 120° C. or lower, even more preferably 110° C. or lower, and even more preferably 100° C. or lower.

<10> The liquid developer according to any one of the above <1> to <9>, wherein the glass transition temperature of the polyester is 40° C. or higher, and preferably 45° C. or higher, and 80° C. or lower, preferably 70° C. or lower, and more preferably 60° C. or lower.

<11> The liquid developer according to any one of the above <1> to <10>, wherein the acid value of the polyester is 1 mgKOH/g or more, preferably 3 mgKOH/g or more, and more preferably 5 mgKOH/g or more, and 110 mgKOH/g or less, preferably 70 mgKOH/g or less, more preferably 50 mgKOH/g or less, even more preferably 30 mgKOH/g or less, even more preferably 20 mgKOH/g or less, and even more preferably 12 mgKOH/g or less.

<12> The liquid developer according to any one of the above <1> to <11>, wherein the content of the pigment is 5 parts by mass or more, preferably 10 parts by mass or more, and more preferably 15 parts by mass or more, based on 100 parts by mass of the resin, and the content is 100 parts by mass or less, preferably 70 parts by mass or less, more preferably 50 parts by mass or less, even more preferably 30 parts by mass or less, and even more preferably 25 parts by mass or less, based on 100 parts by mass of the resin.

<13> The liquid developer according to any one of the above <1> and <3> to <12>, wherein the peak intensity ratio of methyl groups calculated from the formula (1) is 30% or more, and preferably 35% or more, and 65% or less, more preferably 60% or less, and even more preferably 55% or less.

<14> The liquid developer according to any one of the above <2> to <13>, wherein the content of the polyisobutene is 5% by mass or more, preferably 20% by mass or more, more preferably 40% by mass or more, even more preferably 60% by mass or more, and even more preferably 80% by mass or more, of the insulating liquid.

<15> The liquid developer according to any one of the above <1> to <14>, wherein the boiling point of the insulating liquid is 120° C. or higher, preferably 140° C. or higher, more preferably 160° C. or higher, even more preferably 180° C. or higher, even more preferably 200° C. or higher, and even more preferably 220° C. or higher, and 280° C. or lower, and preferably 260° C. or lower.

<16> The liquid developer according to any one of the above <1> to <15>, wherein the viscosity of the insulating liquid at 25° C. is 0.01 mPa·s or more, preferably 0.3 mPa·s or more, more preferably 0.5 mPa·s or more, and even more preferably 0.7 mPa·s or more, and 15 mPa·s or less, preferably 10 mPa·s or less, more preferably 5 mPa·s or less, even more preferably 4 mPa·s or less, and even more preferably 3 mPa·s or less.

<17> The liquid developer according to any one of the above <1> to <16>, wherein the content of the toner particles, based on 100 parts by mass of the insulating liquid, is 10 parts by mass or more, preferably 20 parts by mass or more, more preferably 30 parts by mass or more, and even more preferably 40 parts by mass or more, and 100 parts by mass or less, preferably 80 parts by mass or less, and more preferably 65 parts by mass or less.

<18> The liquid developer according to any one of the above <1> to <17>, wherein the dispersant contains a basic dispersant having a basic adsorbing group.

<19> The liquid developer according to the above <18>, wherein the basic adsorbing group is at least one nitrogen-containing group selected from the group consisting of amino groups (—$NH_2$, —NHR, —NHRR'), an imino group (=NH), an amide group (—C(=O)—NRR'), an imide group (—$N(COR)_2$), a nitro group (—$NO_2$), a cyano group (—CN), an azo group (—N=N—), a diazo group (=$N_2$), and an azide group (—$N_3$), wherein each of R and R' stands for a hydrocarbon group having from 1 to 5 carbon atoms, and the basic adsorbing group is preferably the amino groups or imino group, and more preferably the imino group.

<20> The liquid developer according to the above <18>, wherein the basic dispersant is a condensate of a polyimine and a carboxylic acid.

<21> The liquid developer according to the above <20>, wherein the amine value of the condensate is 20 mgKOH/g or more, preferably 30 mgKOH/g or more, more preferably 40 mgKOH/g or more, and even more preferably 50 mgKOH/g or more, and 150 mgKOH/g or less, preferably 120 mgKOH/g or less, and more preferably 100 mgKOH/g or less.

<22> The liquid developer according to the above <20> or <21>, wherein the weight-average molecular weight of the condensate is 2,000 or more, preferably 4,000 or more, and more preferably 8,000 or more, and 50,000 or less, preferably 40,000 or less, more preferably 30,000 or less, even more preferably 20,000 or less, and even more preferably 15,000 or less.

<23> The liquid developer according to any one of the above <1> to <22>, wherein the content of the dispersant as an effective ingredient, based on 100 parts by mass of the toner particles, is 0.5 parts by mass or more, preferably 1 part by mass or more, and more preferably 2 parts by mass or more, and 20 parts by mass or less, preferably 15 parts by mass or less, more preferably 10 parts by mass or less, and even more preferably 5 parts by mass or less.

<24> The liquid developer according to any one of the above <20> to <23>, wherein the content of the condensate in the dispersant is 50% by mass or more, preferably 70% by mass or more, more preferably 90% by mass or more, even more preferably substantially 100% by mass, and even more preferably 100% by mass.

<25> The liquid developer according to any one of the above <1> to <24>, wherein the solid content concentration of the liquid developer is 10% by mass or more, preferably 15% by mass or more, and more preferably 20% by mass or more, and 50% by mass or less, preferably 45% by mass or less, and more preferably 40% by mass or less.

<26> The liquid developer according to any one of the above <1> to <25>, wherein the volume-median particle size $D_{50}$ of the toner particles in the liquid developer is 0.5 μm or more, preferably 1.0 μm or more, and more preferably 1.5 μm or more, and 5 μm or less, preferably 3 μm or less, and more preferably 2.5 μm or less.

<27> The liquid developer according to any one of the above <1> to <26>, wherein the average circularity of the toner particles in the liquid developer is 0.85 or more, preferably 0.87 or more, more preferably 0.88 or more, even more preferably 0.89 or more, and even more preferably 0.90 or more, and 0.98 or less, preferably 0.97 or less, more preferably 0.96 or less, even more preferably 0.95 or less, and even more preferably 0.94 or less.

<28> The liquid developer according to any one of the above <1> to <27>, wherein the viscosity of the liquid developer at 25° C. is 3 mPa·s or more, preferably 5 mPa·s or more, more preferably 6 mPa·s or more, and even more preferably 7 mPa·s or more, and 50 mPa·s or less, preferably 40 mPa·s or less, more preferably 37 mPa·s or less, even more preferably 35 mPa·s or less, even more preferably 32 mPa·s or less, even more preferably 28 mPa·s or less, even more preferably 26 mPa·s or less, even more preferably 24 mPa·s or less, even more preferably 22 mPa·s or less, and even more preferably 19 mPa·s or less.

<29> Use of an insulating liquid that has a boiling point of 300° C. or lower, the insulating liquid has a peak intensity ratio of a methyl group calculated by the formula (1) of 25% or more as a medium for a liquid developer.

<30> Use of an insulating liquid that has a boiling point of 300° C. or lower, the insulating liquid containing a polyisobutene.

<31> A method for producing a liquid developer containing toner particles containing a resin containing a polyester and a pigment, wherein the toner particles are dispersed in an insulating liquid in the presence of a dispersant, including:

step 1: melt-kneading a resin containing a polyester and a pigment, and pulverizing a kneaded product obtained, to provide toner particles;

step 2: adding a dispersant to the toner particles obtained in the step 1, and dispersing the toner particles in an insulating liquid to provide a dispersion of toner particles, and step 3: subjecting the dispersion of toner particles obtained in the step 2 to wet-milling, to provide a liquid developer, wherein the above insulating liquid has a boiling point of 300° C. or lower, and wherein the insulating liquid has a peak intensity ratio of a methyl group calculated by the formula (1) of 25% or more.

<32> A method for producing a liquid developer containing toner particles containing a resin containing a polyester and a pigment, wherein the toner particles are dispersed in an insulating liquid in the presence of a dispersant, including:

step 1: melt-kneading a resin containing a polyester and a pigment, and pulverizing a kneaded product obtained, to provide toner particles;

step 2: adding a dispersant to the toner particles obtained in the step 1, and dispersing the toner particles in an insulating liquid to provide a dispersion of toner particles; and step 3: subjecting the dispersion of toner particles obtained in the step 2 to wet-milling, to provide a liquid developer, wherein the above insulating liquid has a boiling point of 300° C. or lower, and wherein the insulating liquid contains a polyisobutene.

<33> The method for producing a liquid developer according to the above <31> or <32>, wherein the volume-median particle size $D_{50}$ of the toner particles obtained in the step 1 is 3 μm or more, and preferably 4 μm or more, and 15 μm or less, and preferably 12 μm or less.

<34> The method for producing a liquid developer according to any one of the above <31> to <33>, wherein the solid content concentration of the dispersion of toner particles obtained in the step 2 is 20% by mass or more, preferably 30% by mass or more, and more preferably 33% by mass or more, and 50% by mass or less, preferably 45% by mass or less, and more preferably 40% by mass or less.

The present invention will be described hereinbelow more specifically by the Examples, without intending to limit the present invention to these Examples. The physical properties of the resins and the like were measured in accordance with the following methods.

[Softening Point of Resin]

Using a flow tester "CFT-500D," manufactured by Shimadzu Corporation, a 1 g sample is extruded through a nozzle having a diameter of 1 mm and a length of 1 mm with applying a load of 1.96 MPa thereto with a plunger, while heating the sample at a heating rate of 6° C./min. The softening point refers to a temperature at which half of the sample flows out, when plotting a downward movement of the plunger of the flow tester against temperature.

[Glass Transition Temperature of Resin]

Using a differential scanning calorimeter "DSC210," manufactured by Seiko Instruments Inc., a 0.01 to 0.02 g sample is weighed out in an aluminum pan, heated to 200° C., and cooled from that temperature to 0° C. at a cooling rate of 10° C./min. Next, the temperature of the sample is raised at a heating rate of 10° C./min to measure endothermic peaks. A temperature of an intersection of the extension of the baseline of equal to or lower than the highest temperature of endothermic peak and the tangential line showing the maximum inclination between the kick-off of the peak and the top of the peak is defined as a glass transition temperature.

[Acid Value of Resin]

The acid value is determined by a method according to JIS K0070 except that only the determination solvent is changed from a mixed solvent of ethanol and ether as prescribed in JIS K0070 to a mixed solvent of acetone and toluene in a volume ratio of acetone:toluene=1:1.

[Volume-Median Particle Size of Toner Particles Before Mixing with Insulating Liquid]

Measuring Apparatus: Coulter Multisizer II, manufactured by Beckman Coulter, Inc.

Aperture Diameter: 100 μm

Analyzing Software: Coulter Multisizer AccuComp Ver. 1.19, manufactured by Beckman Coulter, Inc.

Electrolytic Solution: Isotone II, manufactured by Beckman Coulter, Inc. Dispersion: EMULGEN 109P, manufactured by Kao Corporation, polyoxyethylene lauryl ether, HLB (Griffin): 13.6, is dissolved in the above electrolytic solution to adjust to a concentration of 5% by mass to provide a dispersion.

Dispersion Conditions: Ten milligrams of a measurement sample is added to 5 mL of the above dispersion, and the mixture is dispersed for 1 minute with an ultrasonic disperser (name of machine: US-1, manufactured by SND Co., Ltd., output: 80 W), and 25 mL of the above electrolytic solution is then added to the dispersion, and further dispersed with the ultrasonic disperser for 1 minute, to prepare a sample dispersion.

Measurement Conditions: The above sample dispersion is added to 100 mL of the above electrolytic solution to adjust to a concentration at which particle sizes of 30,000 particles can be measured in 20 seconds, and the 30,000 particles are measured, and a volume-median particle size $D_{50}$ is obtained from the particle size distribution.

[Conductivity of Insulating Liquid]

A 40 mL glass sample vial "Vial with screw cap, No. 7," manufactured by Maruemu Corporation is charged with 25 g of an insulating liquid. The conductivity is determined by immersing an electrode in a liquid developer, taking 20 measurements for conductivity with a non-aqueous conductivity meter "DT-700," manufactured by Dispersion Technology, Inc., and calculating an average thereof. The smaller the numerical figures, the higher the resistance.

[Viscosities at 25° C. of Insulating Liquid and Liquid Developer]

A 10-mL glass sample vial with screw cap is charged with 6 to 7 mL, and desirably 7 mL, of a measurement solution, and a viscosity at 25° C. is measured with a torsional oscillation type viscometer "VISCOMATE VM-10A-L," manufactured by SEKONIC CORPORATION, a detection terminal being made of titanium, q 8 mm, in which the sample vial with screw cap is fixed at a position where the liquid surface is leveled at 15 mm above the tip end of the detection terminal.

[Peak Intensity Ratio of Methyl Groups of Insulating Liquid]

Using a Fourier transform infrared spectrometer "FT-710," manufactured by HORIBA, Ltd., absorbance is measured under the conditions of the number of scans: 10, scanning speed: 5, resolution: 4, gain: AUTO, spectrum: ABS. From the spectra obtained, a peak intensity ratio of methyl groups is calculated in accordance with the following formula (1).

$$\text{Peak Intensity Ratio (\%) of Methyl Groups} = \frac{A}{A+B} \times 100 \quad (1)$$

wherein A is a peak intensity ascribed to $CH_3$ stretching vibration when measured with a Fourier transform infrared spectrometer, B is total peak intensities ascribed to $CH_2$ stretching vibration and CH stretching vibration.

[Boiling Point of Insulating Liquid]

Using a differential scanning calorimeter "DSC210," manufactured by Seiko Instruments Inc., a 6.0 to 8.0 g sample is weighed out in an aluminum pan, the temperature of the sample is raised to 350° C. at a heating rate of 10° C./min to measure endothermic peaks. The highest temperature side of the endothermic peak is defined as a boiling point.

[Weight-Average Molecular Weight (Mw) of Condensate of Polyimine and Carboxylic Acid]

The weight-average molecular weight is obtained by measuring a molecular weight distribution in accordance with a gel permeation chromatography (GPC) method.

(1) Preparation of Sample Solution

A dispersant is dissolved in chloroform so as to have a concentration of 0.2 g/100 mL. Next, this solution is filtered with a PTFE-type membrane filter "DISMIC-25JP," manufactured by Toyo Roshi Kaisha, Ltd., having a pore size of 0.20 μm, to remove insoluble components, to provide a sample solution.

(2) Molecular Weight Measurements

Using the following measurement apparatus and analyzing column, a chloroform solution of 100 mmol/L FARMIN DM2098 manufactured by Kao Corporation is allowed to flow through a column as an eluent at a flow rate of 1 mL per minute, the column is stabilized in a thermostat at 40° C., and 100 μl of a sample solution is loaded thereto to carry out measurements. The molecular weight of the sample is calculated based on the previously drawn calibration curve. At this time, a calibration curve is drawn from several kinds of monodisperse polystyrenes, manufactured by Tosoh Corporation, A-500 (Mw: $5.0\times10^2$), A-5000 (Mw: $5.97\times10^3$), F-2 (Mw: $1.81\times10^4$), F-10 (Mw: $9.64\times10^4$), and F-40 (Mw: $4.27\times10^5$) as standard samples. The values within the parentheses show molecular weights.

Measurement Apparatus: HLC-8220GPC, manufactured by Tosoh Corporation

Analyzing Column: K-804L, SHOWA DENKO CORPORATION

[Amine Value of Condensate of Polyimine and Carboxylic Acid]

The amine value is determined on the basis of a method of JIS K2501. Using a potentiometric titrator, an amine value is calculated from an amount titrated by titrating a sample with 0.2 mol/L hydrochloric acid ethanolic standard solution or 0.1 mol/L perchloric acid acetic acid standard solution. Here, in a case where a subject to be measured is a solution of a condensate of a polyimine and a carboxylic acid, the amine value is calculated by converting to an effective ingredient of 100%, taking an effective ingredient concentration into consideration. In other words, an amine value of a condensate of a polyimine and a carboxylic acid contained in the solution is calculated from [amine value of a solution of a condensate of a polyimine and a carboxylic acid]/[concentration of a solution of a condensate of a polyimine and a carboxylic acid]×100.

[Solid Content Concentrations of Dispersion of Toner Particles and Liquid Developer]

Ten parts by mass of a sample is diluted with 90 parts by mass of hexane, and the dilution is spun with a centrifuge "H-201F," manufactured by KOKUSAN Co., Ltd. at a rotational speed of 25,000 r/min for 20 minutes. After allowing the mixture to stand, the supernatant is removed by decantation, the mixture is then diluted with 90 parts by mass of hexane, and the dilution is again centrifuged under the same conditions as above. The supernatant is removed by decantation, and a lower layer is then dried with a vacuum dryer at 0.5 kPa and 40° C. for 8 hours. The solid content concentration is calculated according to the following formula:

$$\text{Solid Content Concentration, \% by Mass} = \frac{\text{Mass of Residues After Drying}}{\text{Mass of Sample, Corresponding to 10 Parts by Mass Portion}} \times 100$$

[Volume-Median Particle Size $D_{50}$ of Toner Particles in Liquid Developer]

A volume-median particle size $D_{50}$ is determined with a laser diffraction/scattering particle size measurement instrument "Mastersizer 2000," manufactured by Malvern Instruments, Ltd., by charging a cell for measurement with Isopar L, manufactured by Exxon Mobile Corporation, isoparaffin, viscosity at 25° C. of 1 mPa·s, under conditions that a particle refractive index is 1.58, imaginary part being 0.1, and a dispersion medium refractive index is 1.42, at a concentration that gives a scattering intensity of from 5 to 15%.

[Average Circularity of Toner Particles in Liquid Developer]

Measuring Apparatus: FPIA-3000, manufactured by SYSMEX CORPORATION

Standard Units: objective lens 10-folds

Measurement Mode: HPF mode

Dispersion: 5% by mass electrolytic solution of EMULGEN 109P, manufactured by Kao Corporation, polyoxyethylene lauryl ether, HLB: 13.6

Dispersion Conditions: Ten milligrams of a measurement sample is added to 10 ml of the dispersion, and the mixture is dispersed for 1 minute with an ultrasonic disperser, and 10 ml of distilled water is then added to the dispersion, and the mixture is further dispersed with the ultrasonic disperser for 2 minutes.

Measurement Conditions: The circularity of a toner dispersed in the dispersion is measured at 20° C. in a concentration that gives a particle density of from 1,800 to 2,200, and a number average is obtained.

Production Example 1 of Resin—Resin A

A 10-L four-neck flask equipped with a nitrogen inlet tube, a dehydration tube, a stirrer, and a thermocouple was charged with raw material monomers, an esterification catalyst, and an esterification promoter, each as listed in Table 1. The contents were heated to 230° C. with a mantle heater, and the mixture was then reacted until a reaction percentage at 230° C. reached 90%, and further reacted at 8.3 kPa until a softening point was reached to the one listed in Table 1, to provide a resin A having physical properties shown in Table 1. Here, the reaction percentage as used herein refers to a value calculated by:

[amount of generated water in reaction (mol)/theoretical amount of generated water (mol)]×100.

Production Example 2 of Resin—Resin B

A 10-L four-neck flask equipped with a nitrogen inlet tube, a dehydration tube, a stirrer, and a thermocouple was charged with raw material monomers and an esterification catalyst, each as listed in Table 1. The contents were heated to 180° C. with a mantle heater, and then heated to 220° C. over 10 hours, and the mixture was reacted until a reaction percentage at 220° C. reached 90%, and further reacted at 8.3 kPa until a softening point listed in Table 1 was reached, to provide a resin B having physical properties shown in Table 1.

TABLE 1

| | | Resin A | Resin B |
|---|---|---|---|
| Raw Material Monomers | BPA-PO | 7,402 g (100) | — |
| | 1,2-Propanediol | — | 3,643 g (100) |
| | Terephthalic Acid | 2,598 g (74) | 6,357 g (80) |
| Esterification Catalyst | Dibutyltin Oxide | 30 g | 30 g |
| Esterification Promoter | Gallic Acid | 3 g | 3 g |
| Physical Properties of Resin | Softening Point, ° C. | 90 | 88 |
| | Glass Transition Temperature, ° C. | 50 | 48 |
| | Acid Value, mgKOH/g | 6 | 8 |

Note 1)
The numerical figures inside the parentheses are expressed by a molar ratio when a total number of moles of alcohol component is defined as 100.
Note 2)
BPA-PO: Polyoxypropylene(2.2)-2,2-bis(4-hydroxyphenyl)propane

Production Example of Polyisobutene

An autoclave was charged with 300 g of isobutene, and isobutene was subjected to a polymerization reaction in the presence of 3 g of aluminum chloride catalyst. Unreacted gas after the termination of the reaction was removed by nitrogen gas replacement, and a polymerization reaction product was drawn out. Subsequently, the catalyst was removed by aqueous alkali solution treatment and water rinsing steps. Further, a 1-L four-neck flask was charged with the polymerization reaction product after water rinsing, the contents were heated with an oil bath, and an unreacted gas component dissolved in the product was removed by nitrogen gas replacement at 40° C. Thereafter, the contents were subjected to a simple distillation at 140° C. at a reduced pressure of 5 kPa, to remove a high-boiling point component having a high degree of polymerization as a residue.

This distilled product was hydrogenated in an autoclave with 10% by mass of a hydrogenation catalyst (0.5% Pd-carrying alumina catalyst) at a hydrogen pressure of 3 MPa and 220° C., to give 100 g of a polyisobutene-α (boiling point: 245° C.).

Production Example of C18-Internal Olefin

The reactions and distillation were carried out in accordance with Example 2 of Japanese Patent Laid-Open No. 2014-142625, to provide a C18-internal olefin β.

The insulating liquids used in Examples and Comparative Examples are as listed in Table 2.

TABLE 2

| Trade Name, Compound Name | Manufacturer, etc. | Chemical Name | Conductivity, S/m | Boiling Point, ° C. | Peak Intensity Ratio of Methyl Group, % | Viscosity at 25° C., mPa · s |
|---|---|---|---|---|---|---|
| NAS-3 | NOF Corporation | Polyisobutene | $1.68 \times 10^{-12}$ | 168 | 49 | 1 |
| NAS-4 | NOF Corporation | Polyisobutene | $1.52 \times 10^{-12}$ | 247 | 48 | 2 |

TABLE 2-continued

| Trade Name, Compound Name | Manufacturer, etc. | Chemical Name | Conductivity, S/m | Boiling Point, ° C. | Peak Intensity Ratio of Methyl Group, % | Viscosity at 25° C., mPa · s |
|---|---|---|---|---|---|---|
| NAS-5H | NOF Corporation | Polyisobutene | $2.44 \times 10^{-12}$ | 288 | 46 | 13 |
| Polyisobutene-α | Synthetic Product | Polyisobutene | $2.50 \times 10^{-12}$ | 245 | 47 | 2 |
| AF Solvent No. 6 | JX Nippon Oil & Energy Corporation | Naphthene Hydrocarbon | $8.29 \times 10^{-13}$ | 323 | 22 | 5 |
| C18-Internal Olefin β | Synthetic Product | C18 Internal Olefin | $1.21 \times 10^{-12}$ | 317 | 15 | 3 |
| Cactus N12D | JX Nippon Oil & Energy Corporation | Liquid Paraffin | $7.34 \times 10^{-12}$ | 213 | 18 | 1 |
| Cactus N14 | JX Nippon Oil & Energy Corporation | Liquid Paraffin | $2.13 \times 10^{-12}$ | 239 | 16 | 2 |

Examples 1 to 10 and Comparative Examples 1 and 2

Eighty-five parts by mass of a resin as listed in Table 3 and 15 parts by mass of a pigment "ECB-301" manufactured by DAINICHISEIKA COLOR & CHEMICALS MFG. CO., LTD., Phthalocyanine Blue 15:3, were previously mixed with a 20-L Henschel mixer while stirring for 3 minutes at a rotational speed of 1,500 r/min (peripheral speed 21.6 m/sec), and the mixture was then melt-kneaded under the conditions given below.

[Melt-Kneading Conditions]

A continuous twin open-roller type kneader "Kneadex," manufactured by NIPPON COKE & ENGINEERING CO., LTD. having an outer diameter of roller of 14 cm and an effective length of roller of 55 cm was used. The operating conditions of the continuous twin open-roller type kneader were a high-rotation roller (front roller) with a peripheral speed of 75 r/min (32.4 m/min), a low-rotation roller (back roller) with a peripheral speed of 35 r/min (15.0 in/min), and a gap between the rollers at an end of the kneaded product-supplying side of 0.1 mm. The temperatures of the heating medium and the cooling medium inside the rollers were as follows. The high-rotation roller had a temperature at the raw material supplying side of 90° C., and a temperature at the kneaded product-discharging side of 85° C., and the low-rotation roller had a temperature at the raw material supplying side of 35° C., and a temperature at the kneaded product-discharging side of 35° C. In addition, the feeding rate of the raw material mixture to the kneader was 10 kg/h, and the average residence time in the kneader was about 3 minutes.

The kneaded product obtained above was roll-cooled with a cooling roller, and the cooled product was roughly pulverized with a hammer-mill to a size of 1 mm or so, and then finely pulverized and classified with an air jet mill "IDS," manufactured by Nippon Pneumatic Mfg. Co., Ltd., to provide toner particles having a volume-median particle size $D_{50}$ of 10 μm.

A 1-L polyethylene vessel was charged with 35 parts by mass of toner particles obtained, 62.9 parts by mass of an insulating liquid as listed in Table 3, and 2.1 parts by mass of a basic dispersant "SOLSPARSE 11200," manufactured by Lubrizol Corporation, a solution of a condensate of a polyimine and a carboxylic acid, effective content: 50%, weight-average molecular weight: 10,400, amine value when calculated as 100% of effective content: 64 mgKOH/g, and the contents were stirred with "T.K. ROBOMIX," manufactured by PRIMIX Corporation, under ice-cooling at a rotational speed of 7,000 r/min for 30 minutes, to provide a dispersion of toner particles having a solid content concentration of 36% by mass.

Next, the dispersion of toner particles obtained was subjected to wet-milling with 6 vessels-type sand mill "TSG-6," manufactured by AIMEX CO., LTD., at a rotational speed of 1,300 r/min (peripheral speed 4.8 msec) using zirconia beads having a diameter of 0.8 mm at a volume filling ratio of 60% by volume, so as to give toner particles having a volume-median particle size $D_{50}$ as listed in Table 3. The beads were removed by filtration, and the filtrate was diluted with an insulating liquid as listed in Table 3 in an amount of 40 parts by mass based on 100 parts by mass of the filtrate, to provide a liquid developer having a solid content concentration of 26% by mass and having physical properties as shown in Table 3.

Test Example 1—Low-Temperature Fusing Ability

A liquid developer was dropped on "POD Gloss Coated Paper" manufactured by Oji Paper Co., Ltd., and produced a thin film with a wire bar, so that the mass on a dry basis was 1.2 g/m$^2$. Thereafter, the produced thin film was held in a thermostat at 60° C. for 10 seconds.

Next, a fusing treatment was carried out at a fusing roller temperature of 60° C. and a fusing speed of 280 mm/sec, with a fuser taken out of "OKI MICROLINE 3010," manufactured by Old Data Corporation. Thereafter, the same fusing treatment as mentioned above was carried out at each temperature while raising the fusing roller temperature up to 160° C. with an increment of 5° C., to provide fused images at each temperature.

The fused images obtained were adhered to a mending tape "Scotch Mending Tape 810," manufactured by 3M, width of 18 mm, the tape was pressed with a roller so as to apply a load of 500 g thereto, and the tape was then removed. The optical densities before and after tape removal were measured with a colorimeter "GretagMacbeth Spectroeye," manufactured by Gretag. The fused image-printed portions were measured at 3 points each, and an average thereof was calculated as an optical density. A fusing ratio (%) was calculated from a value obtained by [optical density after removal]/[optical density before removal]×100, to evaluate low-temperature fusing ability where a temperature at which a fusing ratio reaches 90% or more is defined as a lowest fusing temperature. The results are shown in Table 3. The smaller the numerical value, the more excellent the low-temperature fusing ability.

Test Example 2—Control of Corona Charger Contamination

Using a commercially available printer for liquid developers, a surface potential of a photoconductor was set at 480

V under the environment conditions of 23° C. and 50% RH. The printer was operated only with an insulating liquid for 3 hours, changes in the surface potentials of the photoconductor were measured, and the control of corona charger contamination was evaluated in accordance with the following evaluation criteria. The results are shown in Table 3. Here, in a case where a surface potential changed by ±15 V or more, the generation time of corona charger contamination was also recorded.

[Evaluation Criteria]

AA: no corona charger contamination being found (a change in surface potentials of the photoconductor of less than ±7 V);

A: no corona charger contamination being found (a change in surface potentials of the photoconductor of less than ±10 V);

B: corona charger contamination being slightly found (a change in surface potentials of the photoconductor of less than ±15 V); and C: corona charger contamination being evidently found (a change in surface potentials of the photoconductor of ±15 V or more).

TABLE 3

| | | | Insulating Liquid | | | Liquid Developer | | | Low-Temp. Fusing Ability | Control of Corona Charger Contamination | |
|---|---|---|---|---|---|---|---|---|---|---|---|
| | Resin | Insulating Liquid* | Boiling Point, ° C. | Peak Intensity Ratio of Methyl Group, % | Viscosity, mPa · s | $D_{50}$ of Toner Particles, μm | Viscosity, mPa · s | Average Circularity | Lowest Fusing Temp., ° C. | Evaluation | Generation Time, min |
| Ex. 1 | Resin A | NAS-3 | 168 | 49 | 1 | 2.5 | 8 | 0.90 | 60 | A | — |
| Ex. 2 | Resin A | NAS-4 | 247 | 48 | 2 | 2.5 | 15 | 0.90 | 80 | AA | — |
| Ex. 3 | Resin B | NAS-3 | 168 | 49 | 1 | 2.5 | 7 | 0.89 | 70 | A | — |
| Ex. 4 | Resin A | Polyisobutene α (Synthetic Product) | 245 | 47 | 2 | 2.5 | 16 | 0.90 | 80 | AA | — |
| Ex. 5 | Resin A | NAS-3/NAS-5H = 3/1 | 198 | 48 | 2 | 2.6 | 24 | 0.89 | 80 | A | — |
| Ex. 6 | Resin A | NAS-3/AF Solvent No. 6 = 3/1 | 255 | 36 | 1 | 2.5 | 17 | 0.90 | 80 | AA | — |
| Ex. 7 | Resin A | NAS-3/C18-Internal Olefin β = 3/1 | 251 | 33 | 1 | 2.5 | 14 | 0.90 | 80 | AA | — |
| Ex. 8 | Resin A | NAS-3/Cactus N12D = 3/1 | 177 | 33 | 1 | 2.5 | 9 | 0.90 | 60 | A | — |
| Ex. 9 | Resin A | NAS-3/Cactus N12D = 1/1 | 197 | 26 | 1 | 2.5 | 10 | 0.89 | 70 | B | — |
| Ex. 10 | Resin A | NAS-4/Cactus N14 = 1/1 | 243 | 32 | 2 | 2.7 | 30 | 0.89 | 85 | B | |
| Comp. Ex. 1 | Resin A | Cactus N14 | 239 | 16 | 2 | 2.5 | 15 | 0.88 | 80 | C | 98 |
| Comp. Ex. 2 | Resin A | Cactus N12D | 213 | 18 | 1 | 2.5 | 12 | 0.88 | 70 | C | 30 |

*In a case of a mixture of two kinds, it is expressed in a mass ratio.

It can be seen from the above results that the liquid developers of Examples 1 to 10 have excellent low-temperature fusing ability and controlled corona charger contamination.

On the other hand, the liquid developers of Comparative Examples 1 and 2 generated corona charger contamination even while having excellent low-temperature fusing ability.

The liquid developer of the present invention is suitably used in development or the like of latent images formed in electrophotography, electrostatic recording method, electrostatic printing method or the like.

The invention claimed is:

1. A liquid developer comprising toner particles comprising a resin comprising a polyester and a pigment, wherein the toner particles are dispersed in an insulating liquid in the presence of a dispersant, wherein the insulating liquid has a boiling point of 300° C. or lower, wherein the viscosity of the insulating liquid at 25° C. is 0.01 mPa·s to 15 mPa·s, and wherein the insulating liquid has a peak intensity ratio of a methyl group calculated by the formula (1) of 25% or more:

$$\text{Peak Intensity Ratio (\%) of Methyl Groups} = \frac{A}{A+B} \times 100 \quad (1)$$

wherein A is a peak intensity ascribed to $CH_3$ stretching vibration when measured with a Fourier transform infrared spectrometer, B is a total peak intensity ascribed to $CH_2$ stretching vibration and CH stretching vibration.

2. The liquid developer according to claim 1, wherein the peak intensity ratio of a methyl group calculated by the formula (1) is 30% or more.

3. The liquid developer according to claim 1, wherein the polyester is a polycondensate of an alcohol component comprising a dihydric or higher polyhydric alcohol and a carboxylic acid component comprising a dicarboxylic or higher polycarboxylic acid compound.

4. The liquid developer according to claim 3, wherein the alcohol component comprises 1,2-propanediol or an alkylene oxide adduct of bisphenol A represented by the formula (I):

(I)

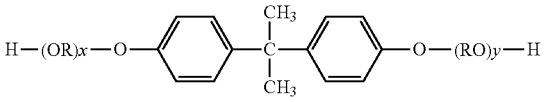

wherein RO and OR are an oxyalkylene group, wherein R is an ethylene group and/or a propylene group; and each of x and y is a positive number showing an average number of moles of alkylene oxide added, wherein a value of the sum of x and y is 1 to 16.

5. The liquid developer according to claim 1, wherein the acid value of the polyester is 3 mgKOH/g to 50 mgKOH/g.

6. The liquid developer according to claim 1, wherein the dispersant comprises a basic dispersant having a basic adsorbing group.

7. The liquid developer according to claim 6, wherein the basic adsorbing group is at least one nitrogen-containing group selected from the group consisting of:

an amino group having a formula of —$NH_2$, —NHR, or —NHRR';

an imino group;

an amide group having a formula of —C(=O)—NRR';

an imide group having a formula of —$N(COR)_2$;

a nitro group;

a cyano group;

an azo group;

a diazo group; and an azide group, wherein each of R and R' stands for a hydrocarbon group having from 1 to 5 carbon atoms.

8. The liquid developer according to claim 6, wherein the basic dispersant is a condensate of a polyimine and a carboxylic acid.

9. The liquid developer according to claim 8, wherein the amine value of the condensate is 20 mgKOH/g to 150 mgKOH/g.

10. The liquid developer according to claim 1, wherein the viscosity of the liquid developer at 25° C. is 3 mPa·s to 50 mPa·s.

11. The liquid developer according to claim 1, wherein the boiling point of the insulting liquid is 120° C. to 280° C.

12. The liquid developer according to claim 1, wherein the volume-median particle size of the toner particles in the liquid developer is 0.5 μm to 5 μm.

13. The liquid developer according to claim 1, wherein the average circularity of the toner particles in the liquid developer is 0.85 to 0.98.

14. A liquid developer comprising toner particles comprising a resin comprising a polyester and a pigment, wherein the toner particles are dispersed in an insulating liquid in the presence of a dispersant, wherein the insulating liquid has a boiling point of 300° C. or lower, wherein the viscosity of the insulating liquid at 25° C. is 0.01 mPa·s to 15 mPa·s, and wherein the insulating liquid comprises a polyisobutene.

15. A method for producing a liquid developer comprising toner particles comprising a resin comprising a polyester and a pigment, wherein the toner particles are dispersed in an insulating liquid in the presence of a dispersant, comprising:

melt-kneading a resin comprising a polyester and a pigment, and pulverizing a kneaded product obtained, to provide toner particles;

adding a dispersant to the toner particles, and dispersing the toner particles in an insulating liquid to provide a dispersion of toner particles; and subjecting the dispersion of toner particles to wet-milling, to provide a liquid developer, wherein the insulating liquid has a boiling point of 300° C. or lower, wherein the viscosity of the insulating liquid at 25° C. is 0.01 mPa·s to 15 mPa·s, and wherein the insulating liquid has a peak intensity ratio of a methyl group calculated by the formula (1) of 25% or more:

$$\text{Peak Intensity Ratio (\%) of Methyl Groups} = \frac{A}{A+B} \times 100 \quad (1)$$

wherein A is a peak intensity ascribed to $CH_3$ stretching vibration when measured with a Fourier transform infrared spectrometer, B is a total peak intensity ascribed to $CH_2$ stretching vibration and CH stretching vibration.

16. A method for producing a liquid developer comprising toner particles comprising a resin comprising a polyester and a pigment, wherein the toner particles are dispersed in an insulating liquid in the presence of a dispersant, comprising:

melt-kneading a resin comprising a polyester and a pigment, and pulverizing a kneaded product obtained, to provide toner particles;

adding a dispersant to the toner particles, and dispersing the toner particles in an insulating liquid to provide a dispersion of toner particles; and subjecting the dispersion of toner particles to wet-milling, to provide a liquid developer, wherein the insulating liquid has a boiling point of 300° C. or lower, wherein the viscosity of the insulating liquid at 25° C. is 0.01 mPa·s to 15 mPa·s, and wherein the insulating liquid comprises a polyisobutene.

* * * * *